US007035562B1

(12) United States Patent
Suzuki et al.

(10) Patent No.: US 7,035,562 B1
(45) Date of Patent: Apr. 25, 2006

(54) IMAGE FORMING APPARATUS WITH A CHANGEABLE TRANSFER BIAS FOR TRANSFERRING A TONER PATCH IMAGE

(75) Inventors: Takehiko Suzuki, Yokohama (JP); Akihiko Takeuchi, Yokohama (JP); Toshihiko Ochiai, Tokyo (JP); Motoi Katoh, Yokohama (JP); Toshiaki Miyashiro, Ichikawa (JP); Takao Kume, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/597,210

(22) Filed: Jun. 20, 2000

Related U.S. Application Data

(63) Continuation-in-part of application No. 08/521,835, filed on Aug. 31, 1995, now Pat. No. 6,091,913.

(30) Foreign Application Priority Data

Aug. 31, 1994 (JP) ..... 1994/206789

(51) Int. Cl.
*G03G 15/00* (2006.01)

(52) U.S. Cl. ..... 399/66; 399/44; 399/49

(58) Field of Classification Search ..... 399/66, 399/44, 302, 308, 303, 312, 313, 314, 49
See application file for complete search history.

(56) References Cited

U.S. PATENT DOCUMENTS

| | | | | |
|---|---|---|---|---|
| 3,781,105 A | | 12/1973 | Meagher | 355/3 |
| 4,277,162 A | | 7/1981 | Kasahara et al. | 355/14 R |
| 4,788,564 A | | 11/1988 | Ochiai | 346/153.1 |
| 5,036,360 A | | 7/1991 | Paxon et al. | 355/208 |
| 5,103,260 A | | 4/1992 | Tompkins et al. | 355/208 |
| 5,155,529 A | | 10/1992 | Rushing | 355/208 |
| 5,198,840 A | | 3/1993 | Ochiai et al. | 346/153.1 |
| 5,294,959 A | | 3/1994 | Nagao et al. | 355/208 |
| 5,296,903 A | | 3/1994 | Suzuki et al. | 355/271 |
| 5,305,057 A | * | 4/1994 | Hattori et al. | 358/300 X |
| 5,313,252 A | | 5/1994 | Castelli et al. | 355/203 |
| 5,333,037 A | | 7/1994 | Inoue et al. | 355/203 |
| 5,521,683 A | | 5/1996 | Miyamoto et al. | 355/246 |
| 5,600,423 A | | 2/1997 | Miyashiro et al. | 399/313 |

(Continued)

FOREIGN PATENT DOCUMENTS

JP 35125 2/1993

(Continued)

OTHER PUBLICATIONS

Eur p an S arch Report, dated Dec. 19, 1995.

*Primary Examiner*—Quana Grainger
(74) *Attorney, Agent, or Firm*—Fitzpatrick, Cella, Harper & Scinto

(57) ABSTRACT

An image forming apparatus includes an image bearing member for carrying a toner image; an image forming unit for forming a toner image on the image bearing member; a transfer material carrying member, for carrying a transfer material, wherein the toner image is transferred onto a transfer material carried on the transfer material carrying member or onto the transfer material carrying member; a density detecting unit for detecting a density of the toner image transferred to the transfer material carrying member; wherein a transfer intensity is smaller when the toner image for density detection is transferred onto the transfer material carrying member than when the toner image is transferred onto the transfer material carried on the transfer material carrying member.

16 Claims, 5 Drawing Sheets

U.S. PATENT DOCUMENTS

| | | | | | |
|---|---|---|---|---|---|
| 5,678,130 | A | | 10/1997 | Enomoto et al. | 399/55 |
| 5,966,561 | A | * | 10/1999 | Yamaguchi | 399/66 |
| 5,983,044 | A | * | 11/1999 | Kodama et al. | 399/49 |

FOREIGN PATENT DOCUMENTS

| | | |
|---|---|---|
| JP | 202493 | 7/1994 |

* cited by examiner

IMAGE FORMING APPARATUS WITH A CHANGEABLE TRANSFER BIAS FOR TRANSFERRING A TONER PATCH IMAGE

This is a continuation application of application Ser. No. 08/521,835, filed Aug. 31, 1995.

FIELD OF THE INVENTION AND RELATED ART

The present invention relates to an image forming apparatus wherein a toner image is transferred from an image bearing member such as photosensitive drum onto a transfer material carried on a transfer material carrying member such as transfer drum, or transfer belt.

Generally, in a color image forming apparatus of electrophotographic type, a positive color tone is not provided if the image density variations due to various conditions such as changes in ambient conditions, number of prints.

Therefore, in order to discriminate the circumstance during image formation, a toner image (patch) for maximum density (Dmax) detection for each color toner is formed on photosensitive drum as a test image, and the density thereof is detected by an optical sensor. The detection result is fed back to the image forming condition such as developing bias to maintain the Dmax for each toner at a predetermined level maximum density control (Dmax control). In order to provide a high quality image, the Dmax for each toner is desirably maintained at a predetermined level, and in addition, the tone gradient reproduction is also desirably correct. In view of this, a plurality of half-tone patches from low density to high density are formed for each toner as test images, and the densities are detected. On the basis of the detection results, a correction (so-called γcorrection) is effected to provide a linear relation between the image signal and the resultant image density (half-tone control).

On the other hand, in order to downsize the main assembly of the device, diameter reduction of the photosensitive drum is effective. This is because the circumferential length of the transfer drum has to be at least the length of the transfer material usable with the apparatus.

In order to eliminate the necessity of the provision of a sensor around the photosensitive drum, it has been proposed to transfer a patch image formed on the photosensitive drum onto the transfer drum and then to detect the transferred patch image by a sensor provided adjacent the transfer drum.

However, there arises a problem that the first sheet after the density control with the patch image on the transfer material drum, involves back side contamination.

The cause has been found as being that the patch image formed for the density control is not completely cleaned with the result that the transfer drum is contaminated after the density control.

There is a problem that under the low humidity ambient condition or high humidity ambient condition, correct image density, or color tone is not provided despite the density control being carried out.

This is because the correct density control is not carried out because of the deterioration of the transfer action due to the shortage of the transfer charge or the excess of the transfer charge resulting in penetration due to the change of the patch toner polarity.

That is, when the image is transferred with low transfer efficiency as a result of transfer defect or penetration (thin image transfer), the density control increases the developing bias despite the fact that the satisfactory development is effected, resulting in the higher density developed image.

Thus, positive image density is not provided, and the tone gradient reproducibility becomes poor.

SUMMARY OF THE INVENTION

Accordingly, it is a principal object of the present invention to provide a control system for an image forming condition of image forming means on the basis of detection of a toner image for density detection.

It is another object of the present invention to provide a transfer system for properly transferring the toner image for the density detection onto the transfer material carrying member.

It is a further object of the present invention to provide a transfer system for a toner image for proper density detection despite the ambience condition change.

While the invention has been described with reference to the structures disclosed herein, it is not confined to the details set forth and this application is intended to cover such modifications or changes as may come within the purpose of the improvements or the scope of the following claims.

DESCRIPTION OF THE PREFERRED EMBODIMENT

Figure 1:
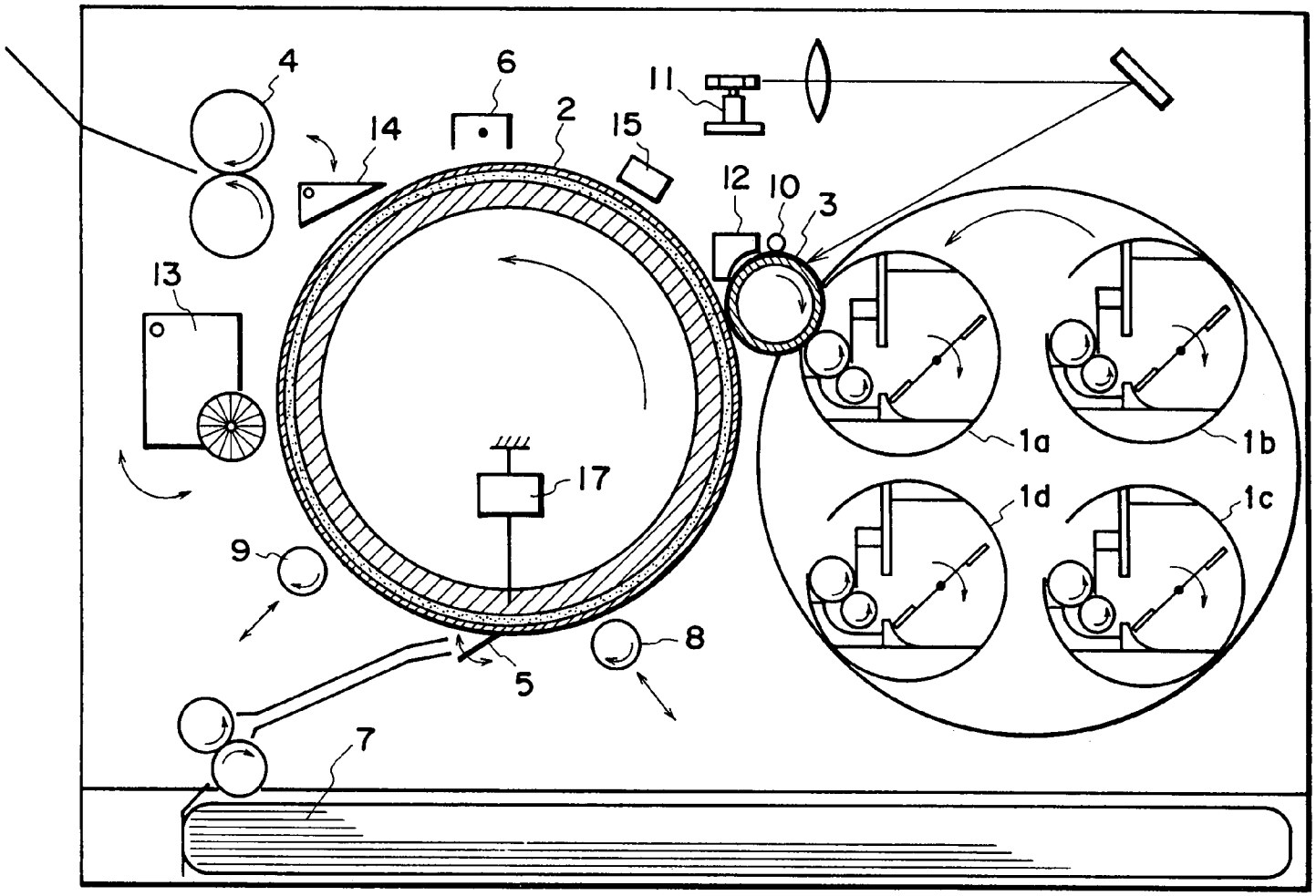
FIG. 1 is an illustration of an image forming apparatus according to embodiment 1 of the present invention.

FIG. 1 is a sectional view of a full-color image forming apparatus of an electrophotographic type according to an embodiment of the present invention.

In the color image forming apparatus, an image bearing member 3 in the form of an electrophotographic photosensitive drum is rotated in a direction indicated by the arrow, and is charged uniformly by charging means 10 during the rotation, and thereafter, it is subjected to a light image projection by a laser exposure device 11 or the like so that the electrostatic latent image is formed on the photosensitive drum 3. The latent image is developed into a visualized image, namely toner image by developing devices 1*a*, 1*b*, 1*c*, 1*d* containing color developers such as yellow (Y), magenta (M), cyan (C), developers, for example, carried on a rotatable supporting member.

In this example, reverse development is used wherein the toner is deposited on the low potential portion provided by the light projection.

Figure 2:
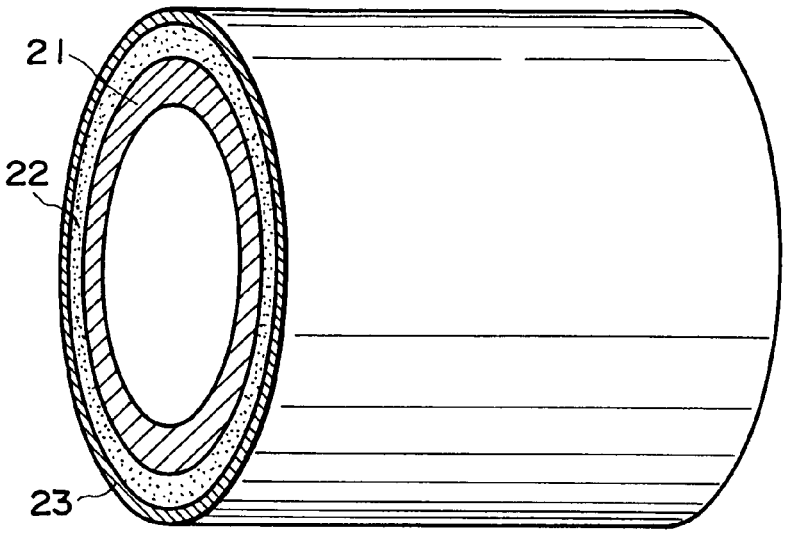
FIG. 2 is a major part illustration of a transfer device of an image forming apparatus according to embodiment 1.

On the other hand, the transfer material 7 is fixed by a gripper 5 on a transfer device 2, having a drum type transfer material carrying member. More particularly, it is electrostatically attracted on the transfer drum 2 by an attracting device 8. The attracting device 8 comprises, as shown in FIG. 2, an aluminum core metal 21, an elastic layer 22, thereon and a dielectric layer 23 for attracting the transfer material on the surface thereof. The toner image on the photosensitive drum 3 is transferred onto a transfer material 7 wound around the transfer device, namely the transfer drum 2 in this example by applying a voltage between the aluminum core metal 21 functioning also as a transfer electrode and the elastic layer 22 from the voltage source 17.

More particularly, an electrostatic latent image formed on the photosensitive drum 3 by the exposure based on an image signal for a first color, is visualized by a developing device 1*a* accommodating the yellow (Y) developer, and thereafter, it is transferred onto the transfer material 7 carried on the transfer drum 2. Subsequently, the remaining developer on the photosensitive drum 3 is removed by a cleaner 12, and thereafter, an electrostatic latent image for the second color is formed on the photosensitive drum 3 by the exposure based on an image signal for the second color. It is visualized by a developing device 1*b* having a magenta (M) developer, for example. Then, it is overlyingly on transferred on the transfer material 7 on the transfer drum 2 having the yellow visualized image. Subsequently, the same process is repeated, and the cyan (C), and black (Bk) toner images are overlyingly transferred onto the transfer material 7 on the transfer drum 2. Thereafter, the transfer material 7 is discharged by a separation discharger 6, and is separated from the transfer drum 2 by a separation claw 14, and the image is fixed by a fixing device 4 into a permanent image.

The transfer drum 2 after the transfer material 7 separation, is cleaned by a transfer member cleaner 13 so that the developer is removed from the surface thereof, and is discharged by a discharger 9 to be electrically initialized.

In this embodiment, the density detection is carried out in the following manner. First, a density detection patch image (patch) of the maximum density (Dmax) of yellow (Y) is formed on the photosensitive drum 3. The patch is transferred onto the transfer drum 2, and the density of the patch is detected by a density sensor 15. Subsequently, a patch image for the Dmax detection is formed with magenta (M) color toner on the photosensitive drum 3, and is transferred onto the transfer drum at a position different from that of the Y toner patch. The density of the patch is detected by the density sensor 15. Similarly, the densities of the cyan (C), and black (Bk) toner images are detected to effect the Dmax control. The order of the colors of the patch images for the density detection may be different.

On the basis of the output of the density sensor, the image forming condition such as an application voltage, or developing bias of the charger 10 is controlled.

In this embodiment, a transfer intensity upon the transfer of the density detection patch image onto the transfer drum 2, is made smaller than the transfer intensity upon the transfer of the toner image onto the transfer material 7 carried on the transfer drum 2.

Therefore, the patch image can be easily removed.

In this embodiment, in order to reduce the transfer intensity, the transfer bias $V_{pat}$ applied from the voltage source 17 upon the density detection operation is made smaller than the transfer bias $V_{tr}$ applied from the voltage source 17 upon the transfer of the toner image onto the transfer material.

Preferably, $V_{pat} \leqq (4/5)V_{tr}$ is satisfied.

Conventionally, the transfer bias upon density detection is the same as the transfer bias upon the normal print. However, the total electrostatic capacity of the nip is larger during the density detection than during the normal print, corresponding to the absence of the transfer material, and therefore, a larger transfer current flows during density detection if the same bias voltage is applied.

Figure 3:
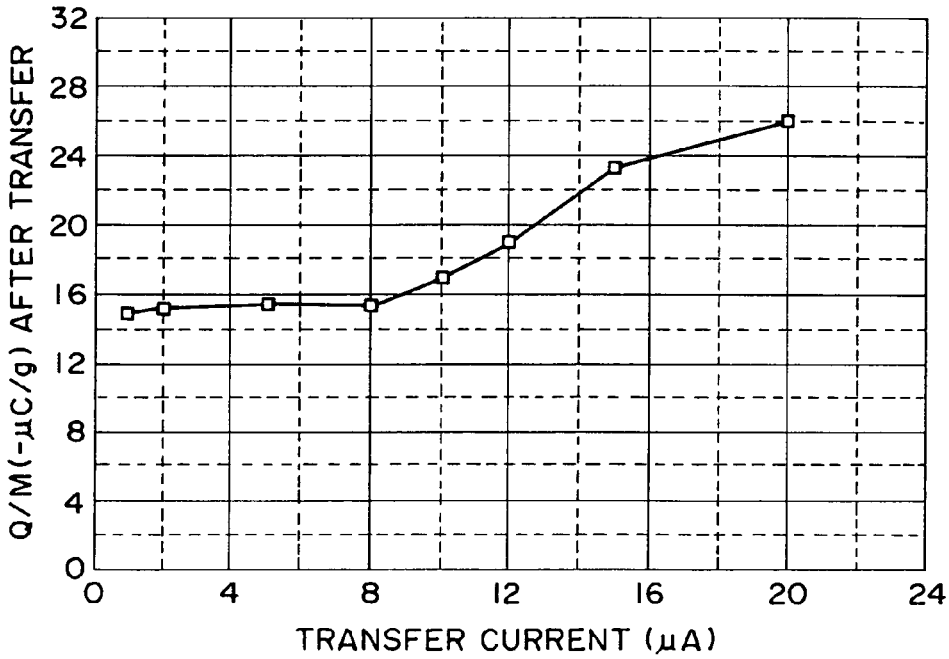
FIG. 3 is a graph showing a relation between a transfer current and Q/M of toner after the transfer.

In a transfer drum type as in this embodiment, the larger the transfer current (positive) as shown in FIG. 3, the larger the charge of the opposite polarity (negative) from the transfer charge is induced in the toner, with the result of higher Q/M (−μC/g) of the toner after the transfer increases.

By application of the charge (positive) of the same polarity as the transfer onto the rear surface of the dielectric layer 23, the air is ionized in the small clearance downstream of the nip between the transfer drum 2 and the photosensitive drum 3, so that negative charge is applied on the surface of the dielectric layer 23.

Thus, with increase of the negative charge of the toner and the positive charge on the dielectric layer 23 rear surface, the Coulomb force between the toner and the transfer drum dielectric layer 23 increases, and therefore, the cleaning property becomes poor.

The following Table 1 shows a relation between the transfer bias for the first color density detection and cleaning property:

TABLE 1

| | (First Color) Vtr1 = 1000 V | | | | | |
|---|---|---|---|---|---|---|
| Transfer Bias (V) | 300 | 500 | 800 | 900 | 1000 | 1200 |
| Cleaning Property | G | G | G | F | NG | NG |

G: good
F: fair
NG: No good

Here, upon 1000V of transfer bias, the transfer current is 14.1 μA, and upon 900V, the current is 10.6 μA, and upon 800V, it is 7.2 μA. It is understood that with the increase of the transfer current, the Q/M of the toner after the transfer increases with the result of the poor cleaning property. Tables 2–4 show relations between the transfer biases for the density detections for the second to the fourth colors and the cleaning property.

TABLE 2

| | (Second color) VTr2 = 1200 V | | | | | |
|---|---|---|---|---|---|---|
| Transfer Bias (V) | 550 | 900 | 1000 | 1100 | 1200 | 1400 |
| Cleaning Property | G | G | F | NG | NG | NG |

TABLE 3

| | (Third color) VTr3 = 1400 V | | | | | |
|---|---|---|---|---|---|---|
| Transfer Bias (V) | 600 | 1100 | 1200 | 1300 | 1400 | 1600 |
| Cleaning Property | G | G | F | NG | NG | NG |

TABLE 4

| | (Fourth color) VTr4 = 1400 V | | | | | |
|---|---|---|---|---|---|---|
| Transfer Bias (V) | 650 | 900 | 1200 | 1400 | 1600 | 1800 |
| Cleaning Property | G | G | G | F | NG | NG |

It has been found that there is an interrelation between the transfer bias and the cleaning property for each color upon the density detection and the transfer bias upon the normal print, more particularly, if the transfer bias during the density detection is not more than ⅘ of the transfer bias during the normal print, the cleaning property is good. In this embodiment, the photosensitive drum is of OPC having a negative charging property. It comprises a charge generating layer and the charge transfer layer having a thickness of 25 microns. The transfer drum comprises a core metal 21 of aluminum as a transfer electrode, an elastic member 22 having a thickness of 5.5 mm aluminum and a volume resistivity of $10^4$ Ohm·cm or smaller, and a dielectric member 23 having a thickness of 75μ and a volume resistivity of $10^{14}$–$10^{16}$ Ohm·cm. The transfer bias during the normal print was 1000V, 1200V, 1400V, 1600V, for the first to fourth colors, and the transfer bias upon density detection was 500V, 550V, 600V, 650V, by which the cleaning was easy, and the back side contamination of the first sheet after the density control could be prevented.

If the transfer bias during the transfer of the density detection patch is too small, the transfer efficiency of the patch image is low, and therefore, the $V_{pat} \geqq (1/5)V_{tr}$ is preferable.

In this embodiment, the transfer biases are different during the density detection and the normal print, but the DC current to be supplied from the voltage source 17 during the density detection may be made smaller than the normal print.

Embodiment 2

Figure 4:
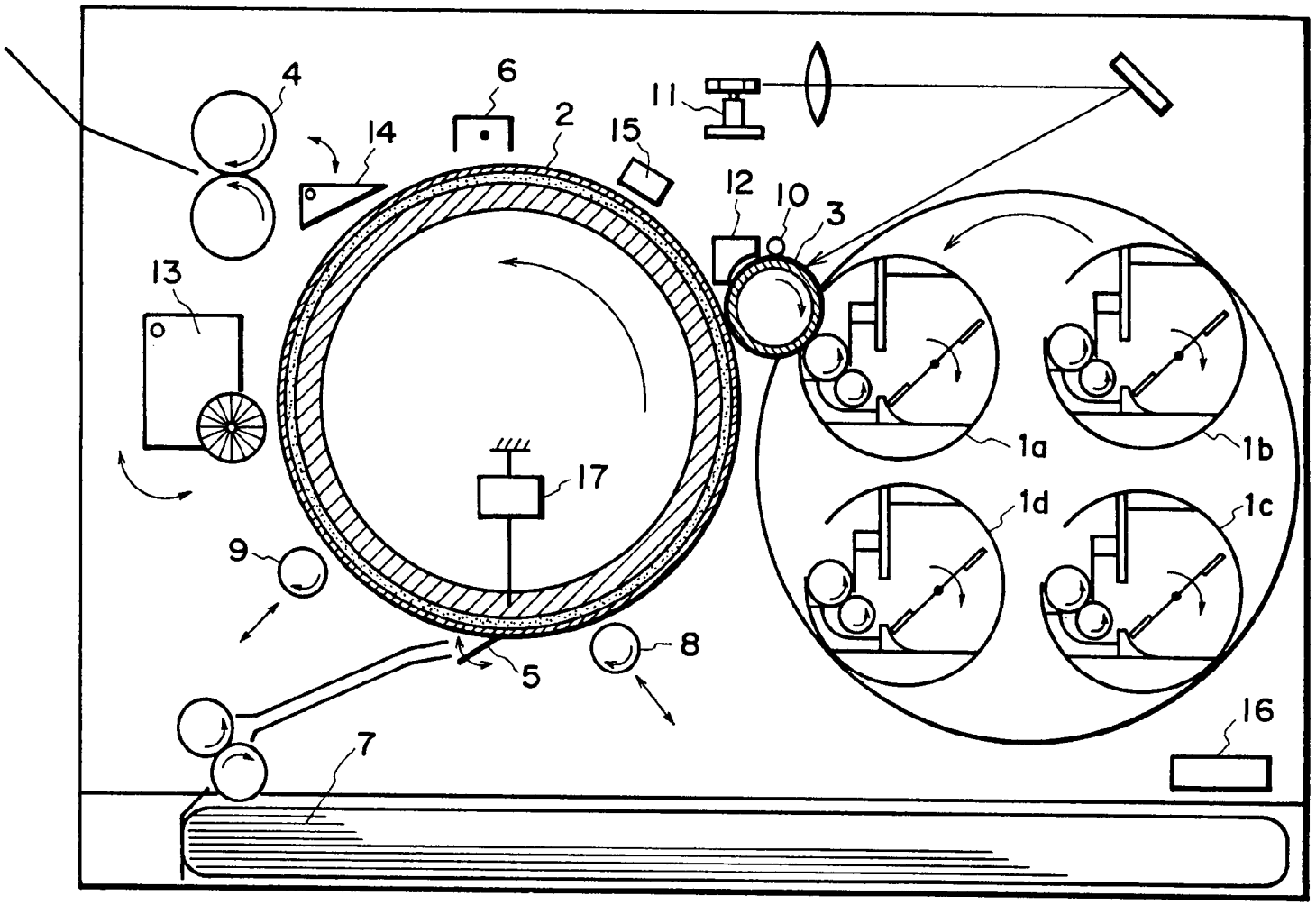
FIG. 4 is an illustration of an image forming apparatus according to embodiment 2 of the present invention.

Referring to FIG. 4, a second embodiment will be described. The same reference numerals as in the first embodiment are assigned to the elements having the corresponding functions, and detailed descriptions thereof are omitted for simplicity. In this embodiment, the temperature/humidity of the ambience is detected by an ambient condition detecting sensor 16, and the transfer bias is changed on the basis of the detection result.

In this embodiment, even if the temperature/humidity of the ambient condition changes, the transfer of the patch image during the density detection is made optimum and the proper density control is assured. If the temperature/humidity of the ambient condition changes, the resistance, and the electrostatic capacity of the dielectric layer 23 and the like change. For example, under a low temperature and low humidity ambient condition the resistance of the dielectric layer 23 is high, and the electrostatic capacity is low. The resistance and electrostatic capacity of the transfer material 7 changes. In this embodiment, the toner is transferred onto the transfer drum 2 by the potential difference between the photosensitive drum 3 and the transfer drum 2. Therefore, when the electrostatic capacity at the transfer position decreases, the potential difference between the photosensitive drum 3 and the transfer drum 2 reduces as compared with the case of the normal temperature/normal humidity ambient condition even if the same bias is applied. So, improper transfer results. On the contrary, under a high temperature and high humidity ambient condition, the potential difference is large with the result of discharge at the transfer position, and therefore, improper transfer.

In this embodiment, in order to provide a high transfer efficiency irrespective of the ambient condition change, the temperature and humidity in the device are detected by a sensor 16, and the transfer bias is controlled on the basis of the detection result.

Figure 5:
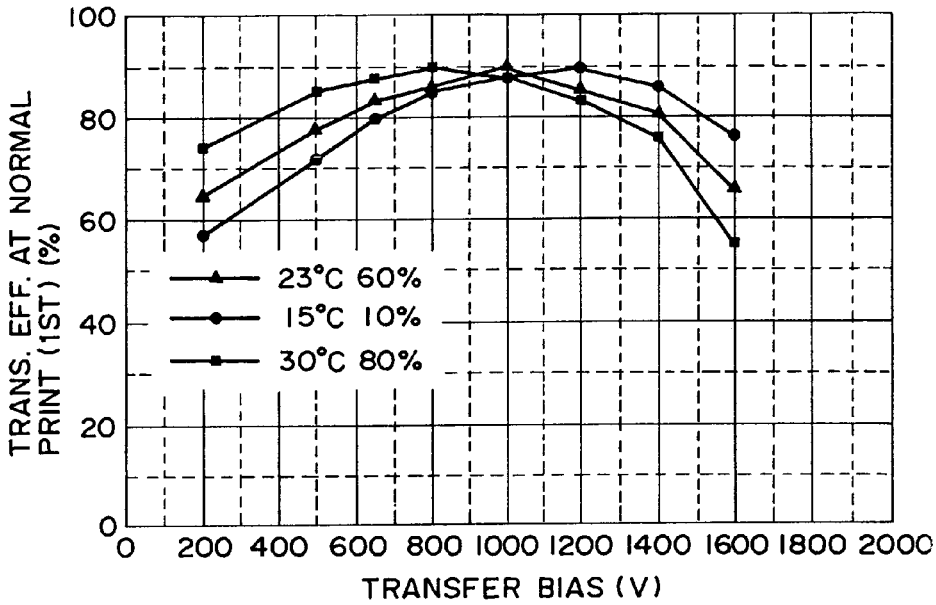
FIG. 5 is a graph showing a transfer efficiency (for temperature/humidity, respectively) during normal print.
Figure 6:
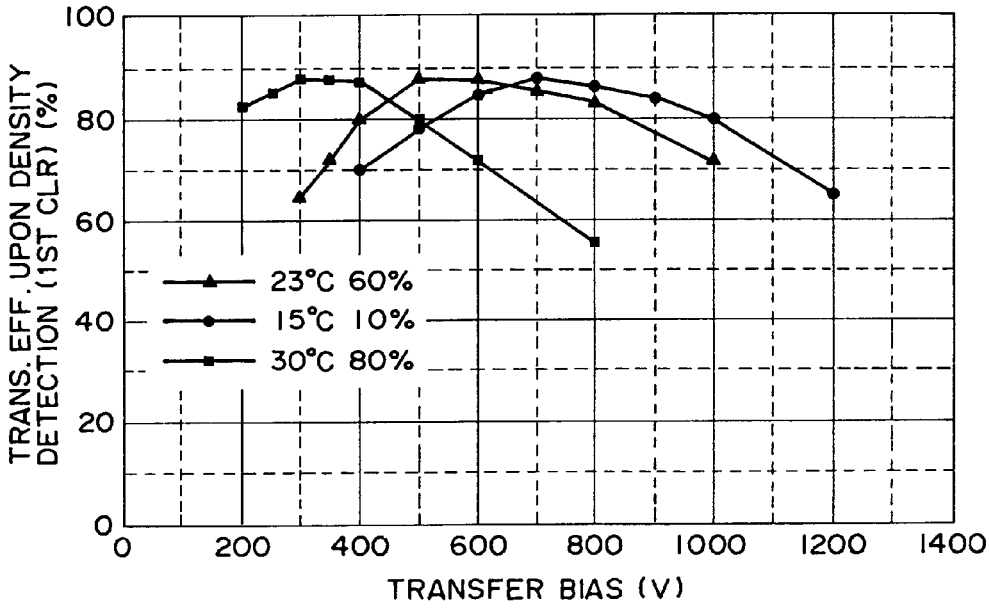
FIG. 6 is a graph showing transfer efficiency (for temperature/humidity, respectively during density detection.

For example, as shown in FIG. 5, during the normal print, the transfer bias for the first color is 800(V), under 38° C., 80% humidity ambient conditions, and 1000(V), under 23° C., 60% humidity ambient conditions, and 1200(V) under 15° C., 10% humidity ambient conditions.

As shown in Table 5 and FIG. 5, the transfer bias for the density detection is controlled on the basis of the detection result of the sensor 16.

This is because there is no transfer material 7 at the transfer position during the density detection, but the electrostatic capacity of the dielectric layer 23 changes depending on the ambience.

During the density detection, there is no transfer material 7 in the transfer position, and therefore, the total electrostatic capacity is larger than during the normal print operation.

Accordingly, as shown in Table 5, for example, during the density detection, transfer bias, for the first color is 350(V), under 30° C., 80% humidity ambient conditions, and 500 (V), under 23° C., 60% humidity ambient conditions, and 700(V) under 15° C., 10% humidity ambient conditions.

In this embodiment, transfer bias for the density detection is smaller than the transfer bias for the normal print under the same ambient conditions.

In this embodiment, the photosensitive drum is of OPC having a negative charging property. It comprises a charge generating layer and the charge transfer layer having a thickness of 25 microns. The transfer drum comprises a core metal 21 of aluminum as a transfer electrode, an elastic member 22 having a thickness of 5.5 mm core metal 21 and a volume resistivity of $10^4$ Ohm·cm or smaller, and a dielectric member 23 having a thickness of 75μ and a volume resistivity of $10^{14}$–$10^{16}$ Ohm.

TABLE 5

| | 15° C. 10% | 23° C. 60% | 30° C. 80% |
|---|---|---|---|
| Bias for first color | 700 V | 500 V | 350 V |
| Bias for second color | 770 V | 550 V | 380 V |
| Bias for third color | 840 V | 600 V | 410 V |
| Bias for fourth color | 910 V | 650 V | 440 V |

Embodiment 3

The same reference numerals as in the foregoing embodiments are assigned to the elements having the corresponding functions, and detailed descriptions thereof are omitted for simplicity. In this embodiment, density control process includes a control process for Dmax control, wherein a voltage $VD_{max}$, and $V_{HT}$ satisfy:

$VDmax > V_{HT}$

In this embodiment, the transfer is optimized by both of the Dmax control and the half-tone control. More particularly, in the Dmax control, one patch image data corresponding to a certain density, FOH of PWM signal, for example, is formed with varied developing bias. In the half-tone control, a plurality of low density patch images corresponding to 10 H, 20 H, 40 H, 80 H, are formed. At this time, the patch images of different PWM signal data have different latent image potentials, since the exposure amounts are different. In this embodiment, the latent image potential when the PWM signal data is FOH, is −220V, and −580V when it is 10 H. In this embodiment, the toner is transferred onto the transfer drum by the potential difference between the photosensitive drum and the transfer drum. Therefore, if the latent image potential is different, the most preferable transfer bias is different.

Figure 7:
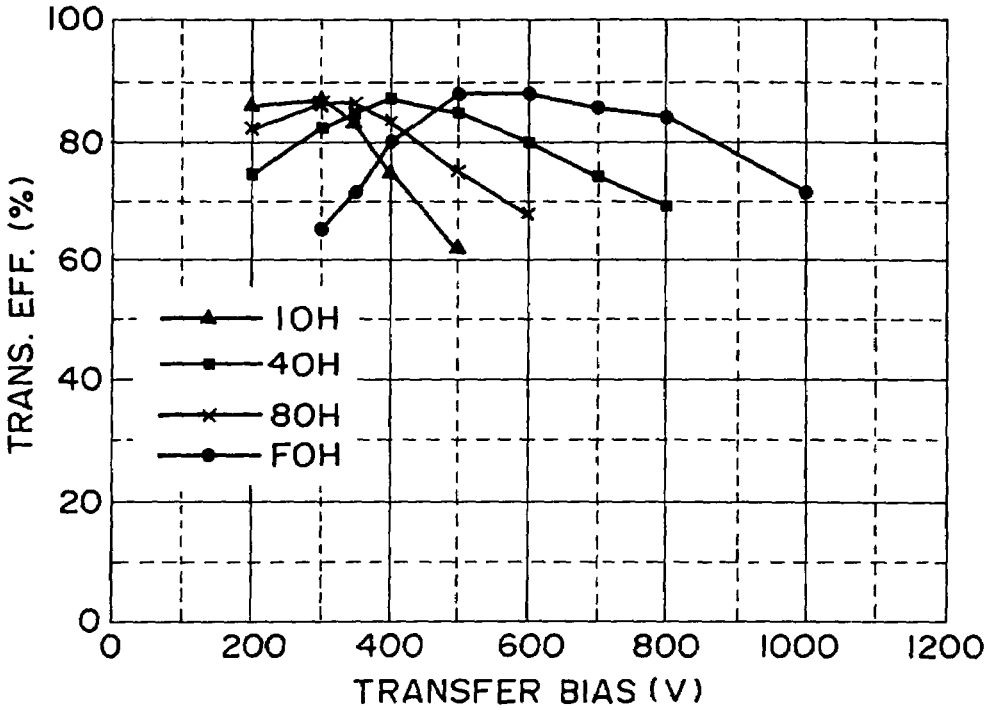
FIG. 7 is a graph showing transfer efficiency (for respective PWM signal data) during density detection.

FIG. 7 shows a relation between the transfer bias and the transfer efficiency upon the density detection relative to different PWM signal data.

With a decrease of the PWM signal, the most preferable transfer bias decreases, and with the increase of the PWM signal, the most preferable transfer bias increases.

If only the patches for 10 H to 80 H are looked at, the most preferable transfer is possible with the same bias voltage. Therefore, in this embodiment, the transfer bias during the Dmax control is 500V, and the transfer bias during the half-tone control is 350V, by which the transfer for both can be optimized. The density control is proper, and the correct image density, and color tone are provided.

Most preferable transfer biases may be set for the PWM signals of 10 H to 80 H, respectively.

It is preferable to detect the temperature/humidity of the ambient conditions, and the transfer bias is controlled on the basis of the result of the detection.

In this embodiment, the photosensitive drum is of OPC having a negative charging property. It comprises a charge generating layer and the charge transfer layer having a thickness of 25 microns. The transfer drum comprises a core metal 21 of aluminum as a transfer electrode, an elastic member 22 having a thickness of 5.5 mm on core metal 21 and a volume resistivity of $10^4$ Ohm·cm or smaller, and a dielectric member 23 having a thickness of 75μ and a volume resistivity of $10^{14}$–$10^{16}$ Ohm. The description is omitted for the second and subsequent colors, since there are the same tendencies.

While the invention has been described with reference to the structures disclosed herein, it is not confined to the details set forth and this application is intended to cover such modifications or changes as may come within the purposes of the improvements or the scope of the following claims.

The invention claimed is:

1. An image forming apparatus comprising:

an image bearing member;

image forming means for forming a toner image and a toner patch image for density detection on said image bearing member;

a transfer device including a transfer medium for transferring the toner image onto a transfer material, wherein said transfer device transfers the toner patch image using a settable transfer bias onto said transfer medium; and a density sensor for detecting a density of the toner patch image transferred onto said transfer medium, wherein an image forming condition for forming the toner image by said image forming means on said image bearing member is controlled in accordance with an output of said density sensor, and wherein a setting value of the transfer bias for transferring the toner patch image onto said transfer medium is changeable in correspondence with a density of a toner patch image to be formed on said image bearing member.

2. An apparatus according to claim 1, wherein a setting value of the transfer bias for the toner patch image when the toner patch image having a maximum density image formed on said image bearing member is transferred onto said transfer medium is larger than a setting value of the transfer bias for the toner patch image when the toner patch image having a halftone density image formed on said image bearing member is transferred onto said transfer medium.

3. An apparatus according to claim 1 or 2, wherein said image forming means includes an exposure device for exposing a surface of said image bearing member, which has been electrically charged, in accordance with image information with an exposure amount, which is changeable in accordance with the density of the toner patch image.

4. An apparatus according to claim 3, wherein a surface potential of said image bearing member exposed by said exposure device is changeable in accordance with the density of the toner patch image.

5. An apparatus according to claim 1 or 2, wherein the setting value of the transfer bias for the toner patch image is changeable in correspondence with a toner gradation level of the toner patch image.

6. An apparatus according to claim 1, wherein the setting value of the transfer bias for the toner patch image corresponds to a voltage level.

7. An apparatus according to claim 1, further comprising an ambient condition sensor for detecting an ambient condition, wherein the setting value of the transfer bias for the toner patch image is changeable in correspondence with an output of said ambient condition sensor.

8. An apparatus according to claim 7, wherein said ambient condition sensor detects temperature.

9. An apparatus according to claim 7 or 8, wherein said ambient condition sensor detects humidity.

10. An apparatus according to claim 1, wherein said image forming means includes a developing device for developing a latent image formed on said image bearing member, and wherein a voltage applied to said developing device is controlled in accordance with an output of said density sensor.

11. An image forming apparatus comprising:

an image bearing member;

image forming means for forming a toner image and a toner patch image for density detection on said image bearing member;

a transfer device having a transfer medium for transferring the toner image onto a transfer material, wherein said transfer device transfers the toner patch image using a settable transfer bias onto said transfer medium;

a density sensor for detecting a density of the toner patch image transferred onto said transfer medium, wherein an image forming condition for forming the toner image by said image forming means on said image bearing member is controlled in accordance with an output of said density sensor; and an ambient condition sensor for detecting an ambient condition, wherein a setting value of the transfer bias for transferring the toner patch image onto said transfer medium is changeable in correspondence with an output of said ambient condition sensor.

12. An apparatus according to claim 11, wherein said ambient condition sensor detects temperature.

13. An apparatus according to claim 11 or 12, wherein said ambient condition sensor detects humidity.

14. An apparatus according to claim 11, wherein the setting value of the transfer bias for the toner patch image bias corresponds to a voltage level.

15. An apparatus according to claim 11, wherein said image forming means includes a developing device for developing a latent image formed on said image bearing member, wherein a voltage applied to said developing device is controlled in accordance with an output of said density sensor.

16. An apparatus according to claim 1 or 11, wherein said transfer medium carries the transfer material.

* * * * *

UNITED STATES PATENT AND TRADEMARK OFFICE

CERTIFICATE OF CORRECTION

PATENT NO. : 7,035,562 B1
APPLICATION NO. : 09/597210
DATED : April 25, 2006
INVENTOR(S) : Takehiko Suzuki et al.

It is certified that error appears in the above-identified patent and that said Letters Patent is hereby corrected as shown below:

ON THE TITLE PAGE

Item (56), Other Publications, "Eur p an S arch Report," should read --European Search Report,--.

Item (63), "Continuation-in-part" should read --Continuation--.

Item (30), Foreign Application Priority Data, "1994/206789" should read --6-206789--.

COLUMN 3

Line 18, "on" should be deleted.

Signed and Sealed this

Tenth Day of October, 2006

JON W. DUDAS
*Director of the United States Patent and Trademark Office*